United States Patent [19]

Laudner

[11] 4,007,874

[45] Feb. 15, 1977

[54] HEATING SYSTEM

[76] Inventor: Wilbert Laudner, Rockwell, Iowa 50469

[22] Filed: Aug. 14, 1975

[21] Appl. No.: 604,797

[52] U.S. Cl. ..... 237/2 B; 62/238; 62/428; 65/29

[51] Int. Cl.[2] ..... G05D 23/00

[58] Field of Search ..... 237/2 B; 62/428, 507, 62/238, 183; 165/29

[56] References Cited

UNITED STATES PATENTS

| | | | |
|---|---|---|---|
| 1,119,011 | 12/1914 | Grosvenor | 62/238 |
| 2,293,482 | 8/1942 | Ambrose | 62/238 |
| 2,376,859 | 5/1945 | Benn | 62/428 |
| 3,444,923 | 5/1969 | Kyle et al. | 165/29 |
| 3,556,203 | 1/1971 | Kyle | 165/29 |
| 3,645,107 | 2/1972 | Quick | 62/183 |

*Primary Examiner*—John J. Camby
*Assistant Examiner*—Henry C. Yuen
*Attorney, Agent, or Firm*—Alan G. Greenberg

[57] ABSTRACT

This invention relates to a heating system for heating a building in which freezers or coolers with remotely located compressors are used. The system draws cold air from the building and by forcing it through the compressors causes it to be heated. Means are provided for delivering the heated air to the building. Supplemental heating means are also provided to further heat the air in case of particularly severe weather.

10 Claims, 3 Drawing Figures

HEATING SYSTEM

This invention relates to a heating system for buildings in which freezers or coolers with remotely located compressors are employed, such as supermarkets, grocery stores and the like.

With the present state of energy availability, it has become incumbent on consumers to economize in its usage wherever possible. At the present time, supermarkets, grocery stores and the like have had to employ costly winter heating systems in the Northern climates. At the same time, heat generated by freezer and cooler compressors is wasted.

The system of the instant invention utilizes the heat generated by the compressors to either fully or partially heat the building.

Referring now to the drawings.

Figure 1:
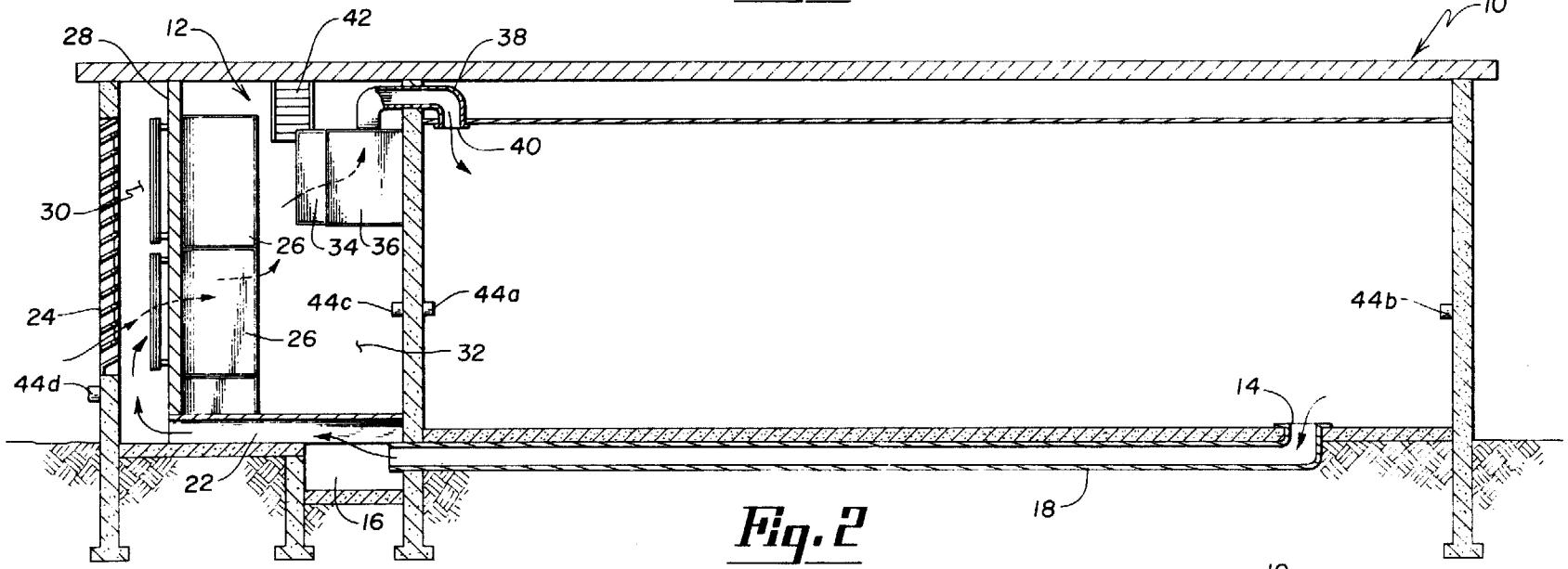
FIG. 1 is a simplified functional elevation of the building incorporating this invention and equipment.
Figure 2:
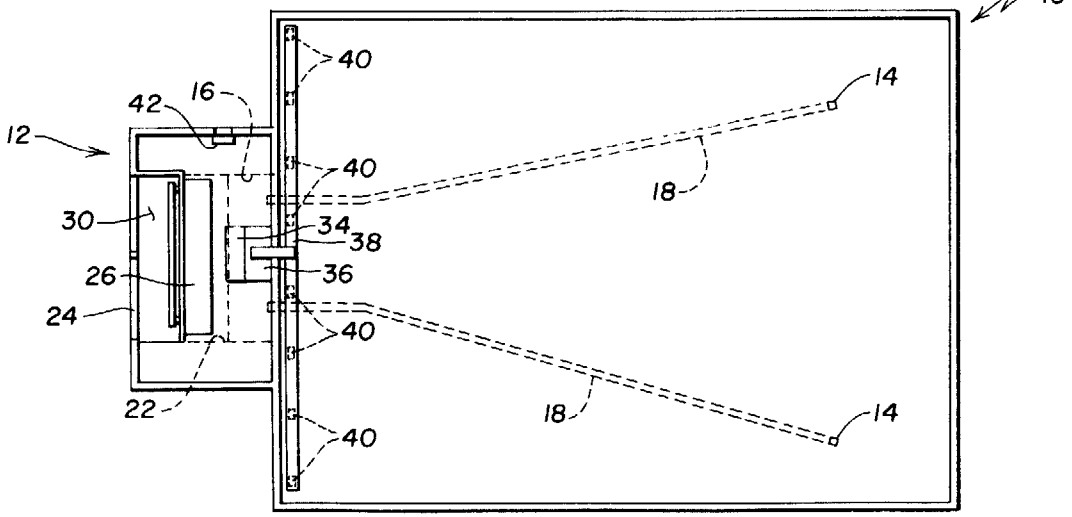
FIG. 2 is a simplified plan view of the building incorporating this invention and equipment to a smaller scale than FIG. 1.
Figure 3:
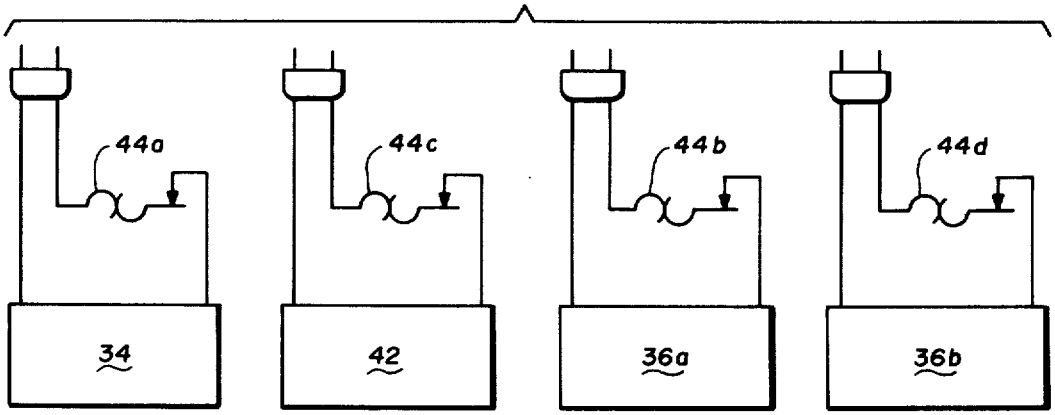
FIG. 3 depicts the wiring of the various components.

In the drawing, building 10 is shown as having a separate compressor housing as compressor room 12.

Cold air is drawn from the floor of building 10 by cold air returns 14. The cold air is conveyed to a pit or sump 16 in compressor room 12 by cold air return ducts 18 to cold side 30. The floor 20 of compressor room 12 is built up to form a flue 22 to the rear of compressor room 12. Means for selectively adding cold make-up air is suitable demonstrated by selectively opening louveres 24.

Compressors 26 for freezers (not shown) in building 10 are stacked to form a partial porous wall. The balance of the area around compressors is sealed by wall 28. The only passage of air through wall 28 is through compressors 26 causing the air to be heated by compressors and delivered to heated side 32.

A means for selectively adding supplemental heat to the heated air is provided as for example, heater 36. A plurality of heaters 36, as **36*a* and 36*b* may be employed depending upon the climate. Means for selectively cooling compressor room 12 is depicted by selectively operable exhaust louveres 42 on heated side 32** and adapted to exhaust air to the outside as required.

Control means for controlling the system in the form of temperature sensing controls as thermostats **44*a*, 44*b*, 44*c* and 44*d*. Thermostat 44*a* is adapted to control air handler 34. Thermostat 44*b* is adapted to control heaters 36 along with thermostat 44*d*. Exhaust louveres 42 are controlled by thermostat 44*c***.

In operation, it will be appreciated that cold air in building is collected by cold air returns 14 and conveyed via cold air return ducts 14 to pit 16 in compressor room 12. Air pressure on heated side 32 is reduced by operation of air handler 34 which causes cold air to be drawn out of flue 22 and through compressors 26 heating the air. If there is not sufficient air coming from building 10 then cold air is drawn through louveres 24 to obtain the required volume.

The warm air is then conveyed by air handler 34 through heaters 36 into hot air ducts 38 out of registers 40 and into building 10 as demanded by the controls.

Thermostat **44*a* controls air handler 34. When heat is required by thermostat 44*a* it will cause air handler to operate. Thermostat 44*b* will start the heaters adding supplemental heat to the air if required and thermostat 44*d* is employed to control the rate of supplemental heating of the air by sensing the outside temperature and turning on heaters 36** appropriate to the condition.

Thermostat **44*c* is provided to sense and control the temperature in heated side 32 by operating exhaust louveres 42 when heated side 32** is too hot.

I claim:

1. A building heating system for buildings containing freezers comprising: A compressor housing for the freezers, external to the area to be heated; means within the area to be heated for collecting cold building air and conveying the cold air to said compressor housing; means operably secured to said compressor housing for selectively adding supplemental cold make-up air to the cold building air; means operably secured in proximity to the compressors for forcing the cold air through the compressors; means for selectively cooling said compressor housing; means operably secured to said compressor housing for conveying heated air out of said compressor housing into the building; means operably secured to said compressor housing for selectively adding supplemental heat to the heated air; and control operably secured to said supplemental cold make-up air means, to said means for selectively cooling said compressor housing, and to said means for adding supplemental heat to the heated air means for controlling the heating system.

2. The heating system of claim 1 further characterized by said means for forcing the cold air through compressors comprising a means for reducing the air pressure on the heated side of the compressors to below the air pressure on the cold side of the compressors.

3. The heating system of claim 2 further characterized by said means for reducing the air pressure comprising an air handler adapted to receive heated air in said compressor housing and convey the heated air in said compressor housing to another location, said air handler adapted to be selectively operated by a temperature sensing means in the building.

4. The heating system of claim 3 further characterized by the means for selectively adding supplemental cold make-up air to the cold building air comprising selectively opening louveres in the outside wall of the compressor housing and adapted to allow selectively variable amounts of outside make-up air into the compressor housing.

5. The heating system of claim 4 further characterized by the means for cooling said compressor housing comprising selectively operable exhaust means on the heated side of said compressor housing, said cooling means being operably connected to a temperature sensing means and adapted to exhaust said heated side of said compressor housing when the temperature therein exceeds a pre-selected level.

6. The heating system of claim 5 further characterized by said means for selectively adding supplemental heat to the heated air comprising of at least one auxiliary heater situated between the air handler and the building, said auxiliary heater adapted to be selectively operated by a temperature sensing means in the building.

7. The heating system of claim 6 further characterized by a temperature sensing device located outside the building and adapted to control the rate at which said auxiliary heaters add supplementary heat to the heated air.

8. The heating system of claim 1 further characterized by the controlling means comprising a plurality of temperature sensing means; one of which is located on the heated side of said compressor housing and adapted to control the means for selectively cooling said compressor housing; another temperature sensing device is located in said building and adapted to control the means for forcing the cold air through the compressors; another temperature sensing device is located in the building and adapted to control the supplemental heater for said heated air; and a temperature sensing device is located on the outside of the building and adapted to control the rate of supplemental heat added to said heated air.

9. A heating system for buildings containing freezers comprising: A closed compressor room separated from the area to be heated; cold air ducts within the area to be heated adapted to collect cold air in the area to be heated and convey the cold air to a cold side of the compressor room; cold air make-up means operably secured to said compressor room adapted to selectively supplement the cold air from the area to be heated; air handling means secured in proximity to the compressors for selectively forcing the cold air across the compressor coils in the compressor room; supplemental heating means operably secured between the compressor coils and the area to be heated for selectively adding supplemental heat to the compressor coil heated air; hot air ducts connecting the warm air side of said compressor room with the area to be heated; exhaust means operably secured to said compressor room for cooling the warm air side of said compressor room when said warm air side attains a temperature above a preselected level; and, control means operably secured to said system comprising a temperature sensing device in the area to be heated adapted to control said air handling means; another temperature sensing device in the area to be heated adapted to control said supplemental heating means; a temperature sensing device in said compressor room on the warm air side and adapted to control said exhaust to cool said compressor room; and a temperature sensing device external to the area to be heated adapted to control the rate of supplemental heating.

10. The heating system of claim 9 further characterized by said supplemental heating means comprising a plurality of heaters which are employed singly or severally as required by said temperature sensing devices in and outside the building.

* * * * *